US008534076B2

(12) United States Patent
Woodcock et al.

(10) Patent No.: US 8,534,076 B2
(45) Date of Patent: Sep. 17, 2013

(54) COMBUSTOR-TURBINE SEAL INTERFACE FOR GAS TURBINE ENGINE

(75) Inventors: Gregory O. Woodcock, Mesa, AZ (US); Bradley Reed Tucker, Chandler, AZ (US); Jason Smoke, Phoenix, AZ (US); Stony Kujala, Tempe, AZ (US); Terrel Kuhn, Mesa, AZ (US)

(73) Assignee: Honeywell Internationl Inc., Morristown, NJ (US)

( * ) Notice: Subject to any disclaimer, the term of this patent is extended or adjusted under 35 U.S.C. 154(b) by 1369 days.

(21) Appl. No.: 12/481,441

(22) Filed: Jun. 9, 2009

(65) Prior Publication Data

US 2010/0307166 A1 Dec. 9, 2010

(51) Int. Cl.

| | |
|---|---|
| ***F02C 7/20*** | (2006.01) |
| ***F04D 29/08*** | (2006.01) |
| ***F01D 11/00*** | (2006.01) |

(52) U.S. Cl.

USPC ..... 60/800; 60/796; 415/138; 415/170.1; 415/174.2

(58) Field of Classification Search

USPC ..... 60/752–760, 796–800, 805, 806, 60/39.37; 415/134–139, 170.1, 174.2

See application file for complete search history.

(56) References Cited

U.S. PATENT DOCUMENTS

| | | | | |
|---|---|---|---|---|
| 4,373,575 | A * | 2/1983 | Hayes | 165/7 |
| 4,534,700 | A | 8/1985 | Horler et al. | |
| 4,821,522 | A | 4/1989 | Matthews et al. | |
| 4,863,345 | A | 9/1989 | Thompson et al. | |
| 5,118,120 | A | 6/1992 | Drerup et al. | |
| 5,149,250 | A * | 9/1992 | Plemmons et al. | 415/209.3 |
| 5,289,677 | A | 3/1994 | Jarrell | |
| 5,480,162 | A | 1/1996 | Beeman, Jr. | |
| 5,765,833 | A * | 6/1998 | Able et al. | 277/355 |
| 6,116,852 | A | 9/2000 | Pierre et al. | |
| 6,464,232 | B1 | 10/2002 | Marchi et al. | |
| 6,547,257 | B2 * | 4/2003 | Cromer | 277/630 |
| 6,652,231 | B2 * | 11/2003 | Vedantam et al. | 415/214.1 |
| 6,752,592 | B2 | 6/2004 | Mohammed-Fakir et al. | |
| 6,854,738 | B2 * | 2/2005 | Matsuda et al. | 277/632 |
| 6,895,757 | B2 | 5/2005 | Mitchell et al. | |
| 6,895,761 | B2 | 5/2005 | Mitchell et al. | |
| 6,920,762 | B2 | 7/2005 | Wells et al. | |
| 6,942,445 | B2 * | 9/2005 | Morris et al. | 415/1 |
| 7,040,098 | B2 | 5/2006 | Lepretre et al. | |
| 7,073,336 | B2 | 7/2006 | Lepretre et al. | |
| 7,090,224 | B2 | 8/2006 | Iguchi et al. | |
| 7,128,323 | B2 | 10/2006 | Iguchi et al. | |
| 7,140,840 | B2 | 11/2006 | Taillant et al. | |
| 7,178,340 | B2 | 2/2007 | Jorgensen | |
| 7,197,882 | B2 | 4/2007 | Marnas et al. | |
| 7,497,443 | B1 * | 3/2009 | Steinetz et al. | 277/644 |
| 2003/0005705 | A1 | 1/2003 | Chan et al. | |
| 2009/0026713 | A1 * | 1/2009 | Fujimoto et al. | 277/543 |

* cited by examiner

*Primary Examiner* — Ehud Gartenberg
*Assistant Examiner* — Karthik Subramanian
(74) *Attorney, Agent, or Firm* — Ingrassia Fisher & Lorenz, P.C.

(57) ABSTRACT

A combustor-turbine seal interface is provided for deployment within a gas turbine engine. In one embodiment, the combustor-turbine assembly a combustor, a turbine nozzle downstream of the combustor, and a first compliant dual seal assembly. The first compliant dual seal assembly includes a compliant seal wall sealingly coupled between the combustor and the turbine nozzle, a first compression seal sealingly disposed between the compliant seal wall and the turbine nozzle, and a first bearing seal generally defined by the compliant seal wall and the turbine nozzle. The first bearing seal is sealingly disposed in series with the first compression seal.

19 Claims, 5 Drawing Sheets

COMBUSTOR-TURBINE SEAL INTERFACE FOR GAS TURBINE ENGINE

STATEMENT REGARDING FEDERALLY SPONSORED RESEARCH OR DEVELOPMENT

This invention was made with Government support under Contract No. W911W6-08-2-0001 awarded by U.S. Army. The Government has certain rights in this invention.

TECHNICAL FIELD

The present invention relates generally to gas turbine engines and, more particularly, to a combustor-turbine seal interface having improved leakage, cooling, and compliancy characteristics.

BACKGROUND

A generalized gas turbine engine (GTE) includes an intake section, a compressor section, a combustion section, a turbine section, and an exhaust section disposed in axial flow series. The compressor section includes one or more compressor stages, and the turbine section includes one or more air turbine stages each joined to a different compressor stage via a rotatable shaft or spool. During operation, the compressor stages rotate to compress air received from the intake section of the GTE. A first portion of the compressed air is directed into an annular combustor mounted within the combustion section, and a second portion of the air is directed through cooling flow passages that flow over and around the combustor. Within the combustion chamber, the compressed air is mixed with fuel and ignited. The air heats rapidly and exits each combustor chamber via an outlet provided through the combustor's downstream end. The air is received by at least one turbine nozzle, which is sealingly coupled to the combustor's downstream end. The turbine nozzle directs the air through the air turbines to drive the rotation of the air turbines, as well as the rotation of the spools and compressor stages coupled thereto. Finally, the air is expelled from the GTE's exhaust section. The power output of the GTE may be utilized in a variety of different manners, depending upon whether the GTE assumes the form of a turbofan, turboprop, turboshaft, or turbojet engine.

The sealing interface between the turbine nozzle and the combustor preferably maximizes the operational lifespan of the GTE while simultaneously minimizing leakage between the turbine nozzle and the combustor. It has, however, proven difficult to design a durable, low leakage combustor-turbine seal interface largely due to the extreme thermal gradients that result from temperature fluctuations in the air exhausted from the combustor, as well as the temperature differentials between the air exhausted from the combustor and the cooler air bypassing the conductor. Such thermal gradients cause thermal distortion and relative movement between the various components of the combustor-turbine seal interface; e.g., between the liner walls and the turbine nozzle, which become relatively hot during combustion, and the engine casing, which remains relatively cool during combustion and which may be fabricated from a low thermal growth material, such as a titanium-based alloy. As a result of thermal distortion, leakage paths may form between mating components even if such components fit closely in a non-distorted, pre-combustion state. Compression seals (e.g., metallic W-seals) may be employed to minimize the formation of such leakage paths; however, such compression seals may also be heated to undesirably high temperatures by the hot air exhausted from the combustor, and the sealing characteristics and strength of the compliant seals can be compromised. Furthermore, if the components of the combustor-turbine seal interface are unable to adequately accommodate such thermal distortion, the combustor-turbine seal interface may experience relatively rapid thermomechanical fatigue and decreases in performance. The GTE may consequently require premature removal from service and repair, resulting in economic loss due to the non-availability of the GTE, as well as direct maintenance costs.

There thus exists an ongoing need to provide a combustor-turbine seal interface that significantly reduces or eliminates leakage between a combustor and a turbine nozzle (or nozzles). Ideally, embodiments of such a combustor-turbine seal interface would include one or more compliant structures that accommodate relative movement between the combustor, the turbine nozzle, and the engine casing to reduce thermomechanical fatigue and increase operational lifespan of combustor-turbine seal interface. It would also be desirable for embodiments of such a combustor-turbine seal interface to promote efficient cooling of the combustor and, perhaps, of the leading edge portion of the turbine nozzle. Lastly, it would be desirable for embodiments of the combustor-turbine seal interface to provide aerodynamically efficient flow paths for the heated air exhausted from the combustor, as well as for the cooler air bypassing the combustor. Other desirable features and characteristics of the present invention will become apparent from the subsequent Detailed Description and the appended Claims, taken in conjunction with the accompanying Drawings and this Background.

BRIEF SUMMARY

A combustor-turbine seal interface is provided for deployment within a gas turbine engine. In one embodiment, the combustor-turbine seal interface comprising combustor, a turbine nozzle downstream of the combustor, and a first compliant dual seal assembly. The first compliant dual seal assembly includes a compliant seal wall sealingly coupled between the combustor and the turbine nozzle, a first compression seal sealingly disposed between the compliant seal wall and the turbine nozzle, and a first bearing seal generally defined by the compliant seal wall and the turbine nozzle. The first bearing seal is sealingly disposed in series with the first compression seal.

BRIEF DESCRIPTION OF THE DRAWINGS

At least one example of the present invention will hereinafter be described in conjunction with the following figures, wherein like numerals denote like elements, and.

DETAILED DESCRIPTION

The following Detailed Description is merely exemplary in nature and is not intended to limit the invention or the application and uses of the invention. Furthermore, there is no intention to be bound by any theory presented in the preceding Background or the following Detailed Description.

Figure 1:
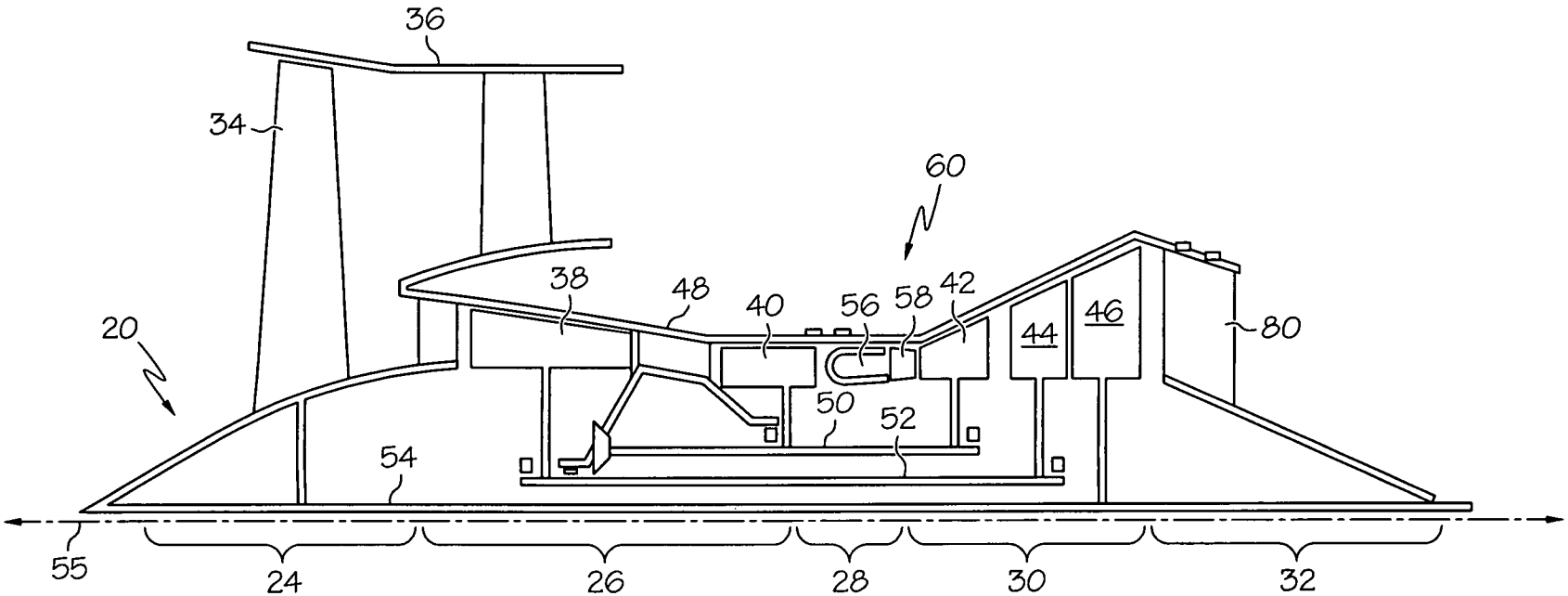
FIG. 1 is a generalized cross-sectional view of the upper portion of an exemplary gas turbine engine.

FIG. 1 is a generalized cross-sectional view of the upper portion of an exemplary gas turbine engine (GTE) 20. In the exemplary embodiment illustrated in FIG. 1, GTE 20 assumes the form of a three spool turbofan engine including an intake section 24, a compressor section 26, a combustion section 28, a turbine section 30, and an exhaust section 32. Intake section 24 includes a fan 34, which may be mounted within an outer fan case 36 Compressor section 26 includes an intermediate pressure (IP) compressor 38 and a high pressure (HP) compressor 40; and turbine section 30 includes an HP turbine 42, an IP turbine 44, and a low pressure (LP) turbine 46. IP compressor 38, HP compressor 40, HP turbine 42, IP turbine 44, and LP turbine 46 are disposed within a main engine casing 48 in axial flow series. HP compressor 40 and HP turbine 42 are mounted on opposing ends of an HP shaft or spool 50; IP compressor 38 and IP turbine 44 are mounted on opposing ends of an IP spool 52; and fan 34 and LP turbine 46 are mounted on opposing ends of a LP spool 54. LP spool 54, IP spool 52, and HP spool 50 are substantially co-axial. That is, LP spool 54 extends through a longitudinal channel provided through IP spool 52, and IP spool 52 extends through a longitudinal channel provided through HP spool 50. Combustion section 28 and turbine section 30 further include an annular combustor 56 and an annular turbine nozzle 58, which sealingly mates with annular combustor 56 as described more fully below.

As illustrated in FIG. 1 and described herein, GTE 20 is offered by way of example only. It will be readily appreciated that embodiments of the present invention are equally applicable to various other types of gas turbine engine including, but not limited to, other types of turbofan, turboprop, turboshaft, and turbojet engines. Furthermore, the particular structure of GTE 20 will inevitably vary amongst different embodiments. For example, in certain embodiments, an open rotor configuration may be employed wherein fan 34 is not mounted within an outer fan case. In other embodiments, the GTE may employ radially disposed (centrifugal) compressors instead of axial compressors. In still further embodiments, GTE 20 may not include a single, annular turbine nozzle and may instead include a number of turbine nozzles, which are circumferentially arranged around the longitudinal axis of GTE 20 (represented in FIG. 1 by dashed line 55) and each sealingly coupled to annular combustor 56.

Figure 2:
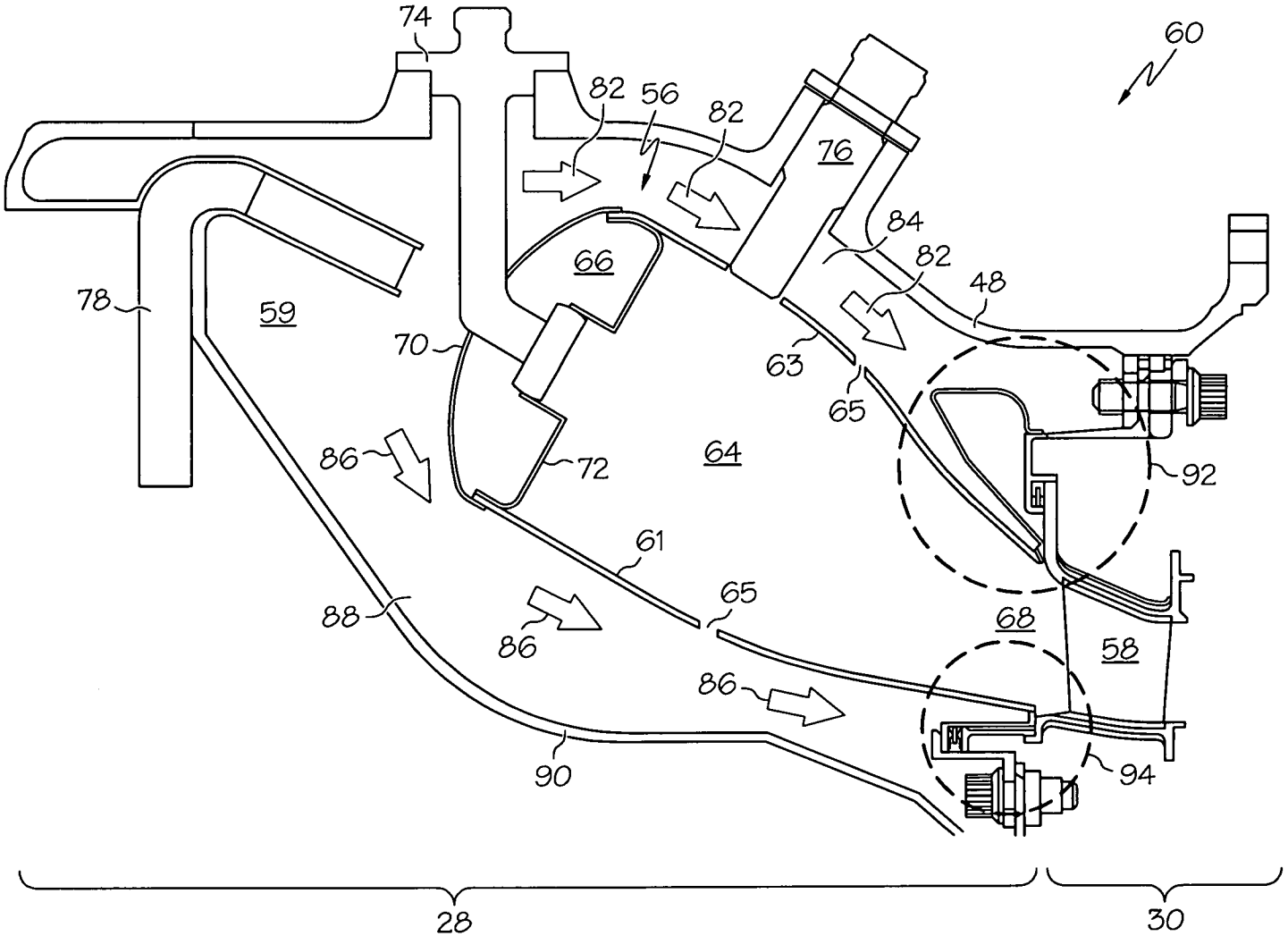
FIG. 2 is a generalized cross-sectional view of an exemplary combustor-turbine seal interface deployed within the gas turbine engine shown in FIG. 1.

FIG. 2 is a generalized cross-sectional view of combustion section 28 and turbine nozzle 58 illustrating combustor-turbine seal interface 60 in accordance with an exemplary embodiment. Combustor 56 is mounted within a cavity 59 provided within engine casing 48. Combustor 56 includes an inner liner wall 61 and an outer liner wall 63. Inner liner wall 61 and outer liner wall 63 each have a generally conical shape and collectively define an annular combustion chamber 64 within combustor 56. As is conventionally known, liner walls 61 and 63 may be formed from a temperature-resistant material (e.g., a ceramic, a metal, or an alloy, such as a nickel-based super alloy), and the interior of liner walls 61 and 63 may each be coated with a thermal barrier coating (TBC) material, such as a friable grade insulation. Additionally, a number of small apertures 65 may be formed through liner walls 61 and 63 (e.g., via a laser drilling process) for effusion cooling or aerodynamic purposes (only two effusion cooling apertures 65 are shown in FIG. 2 and exaggerated for clarity).

Combustor 56 further includes a combustor dome inlet 66 and a combustor outlet 68 formed through leading and trailing end portions of combustor 56, respectively. Combustor dome inlet 66 and effusion apertures 65 fluidly couple cavity 59 to combustion chamber 64, and combustor outlet 68 fluidly couples combustion chamber 64 to turbine nozzle 58. A combustor dome shroud 70 is mounted to liner wall 61 and to liner wall 63 proximate the leading end portion of combustion chamber 64 and partially encloses combustor dome inlet 66. A carburetor assembly 72 is mounted within combustion chamber 64 proximate the leading end portion of combustor 56. Carburetor assembly 72 receives the distal end of a fuel injector 74, which extends radially inward from an outer portion of engine casing 48 as generally shown in FIG. 2.

A diffuser 78 is mounted within engine casing 48 upstream of combustor 56. During operation of GTE 20 (FIG. 1), diffuser 78 directs compressed air received from compressor section 26 (FIG. 1) into cavity 59. A portion of the compressed air supplied by diffuser 78 flows through combustor dome shroud 70 and into carburetor assembly 72. Carburetor assembly 72 mixes this air with fuel and air received from fuel injector 74 and introduces the resulting fuel-air mixture into combustion chamber 64. Within combustion chamber 64, the fuel-air mixture is ignited by an igniter 76 mounted through liner wall 63. The air heats rapidly, exits combustion chamber 64 via outlet 66, and flows into turbine nozzle 58. Turbine nozzle 58 then directs the air through the sequential series of air turbines mounted within turbine section 30 (i.e., turbines 42, 44, and 46 shown in FIG. 1) to drive the rotation of the air turbines and, therefore, the rotation of the fan and compressor stages mechanically coupled thereto. In the embodiments wherein GTE 20 assumes the form of a turbojet, the air is subsequently exhausted (e.g., via a nozzle 80 provided in exhaust section 32 shown in FIG. 1) to produce forward thrust.

A certain volume of the air supplied by diffuser 78 into cavity 59 is directed over and around combustor 56. As indicated in FIG. 2 by arrows 82, a first portion of this air flows along a first cooling flow path 84 generally defined by outer portion of liner wall 63 and an inner portion of engine casing 48. Similarly, as indicated in FIG. 2 by arrows 86, a second portion of the compressed air flows along a second cooling path 88 generally defined by an inner portion of liner wall 61 and an internal mounting structure 90 provided within engine casing 48. The air flowing along cooling flow paths 84 and 88 is considerably cooler than the air exhausted from combustion chamber 64. Airflow along cooling flow paths 84 and 88 is utilized to convectively cool combustor 56, turbine nozzle 58, and the other components of combustor-turbine seal interface 60. With respect to combustor 56, in particular, airflow along cooling flow paths 84 and 88 may convectively cool the exterior of liner walls 61 and 63 through direct convection. Furthermore, in embodiments wherein liner walls 61 and 63 are provided with effusion apertures 65, the air conducted along cooling flow paths 84 and 88 may also cool liner walls 61 and 63 via convection cooling through effusion apertures 65. Effusion apertures 65 may also help create a cool barrier air film along the inner surface of liner walls 61 and 63 defining combustion chamber 64. The combustion process (through radiation heat transfer) and flow of exhaust from combustor 56 (through convection), in concert with airflow along cooling flow paths 84 and 88, results in thermal gradients between the various components of combustor-turbine seal interface 60. Due to such thermal gradients, turbine nozzle 58, liner wall 61, and liner wall 63 will typically become relatively hot during combustion, while engine casing 48 and other surrounding components remain relatively cool.

As a point of emphasis, embodiments of the combustor-turbine seal interface employ at least one compliant dual seal assembly to sealingly couple the combustor to the turbine nozzle (or nozzles). In the exemplary embodiment illustrated in FIG. 2, combustor 56 is sealingly coupled to turbine nozzle 58 utilizing two compliant dual seal assemblies, namely, a first compliant dual seal assembly 92 and a second compliant dual seal assembly 94. First and second compliant dual seal assemblies 92 and 94 are each sealingly coupled between a downstream or trailing end portion of combustor 56 and an upstream or leading end portion of turbine nozzle 58. In addition, first compliant dual seal assembly 92 is coupled between an outer portion of liner wall 63 and an outer portion of turbine nozzle 58; and second compliant dual seal assembly 94 is coupled between an inner portion of liner wall 61 and an inner portion of turbine nozzle 58. First compliant dual seal assembly 92 resides further from the longitudinal axis of GTE 20 (FIG. 1) than does second compliant dual seal assembly 94.

Figure 3:
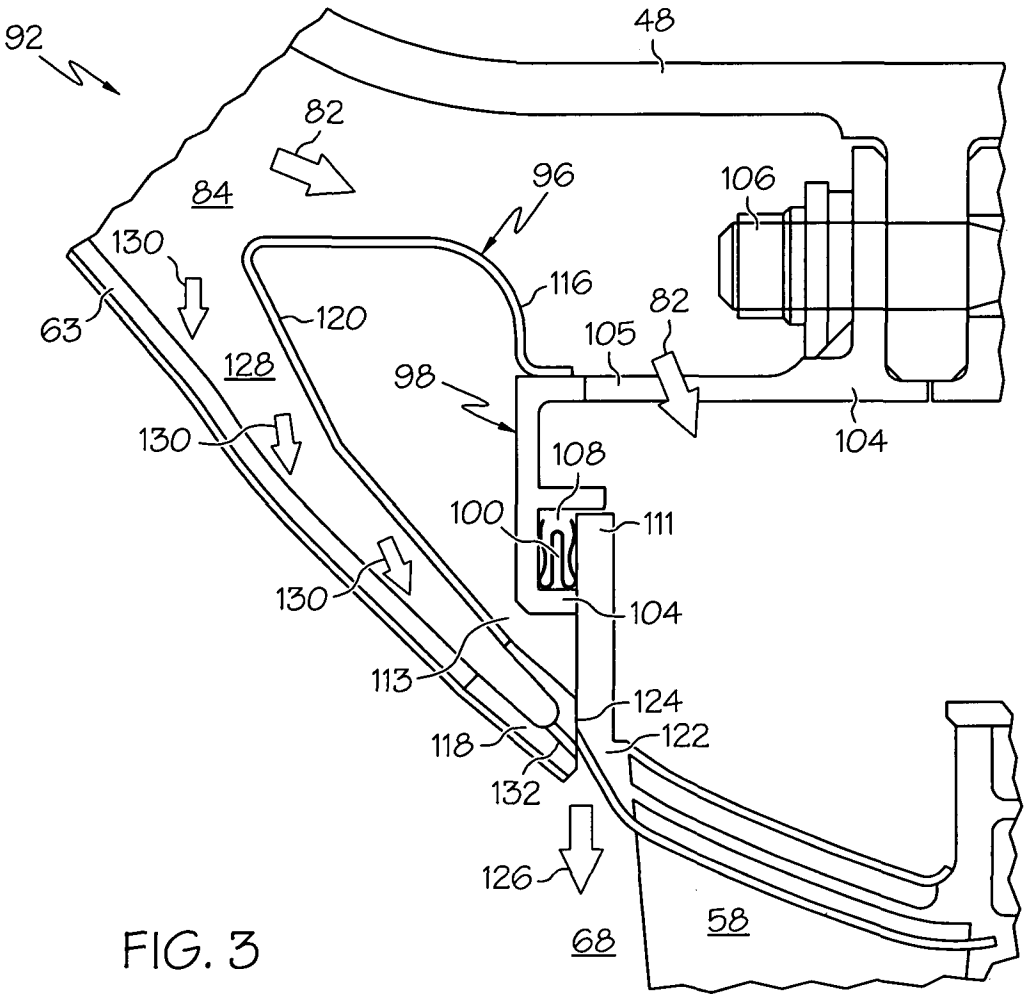
FIG. 3 is a cross-sectional view illustrating a first compliant dual seal assembly employed by the combustor-turbine seal interface shown in FIG. 2 in accordance with an exemplary embodiment.
Figure 4:
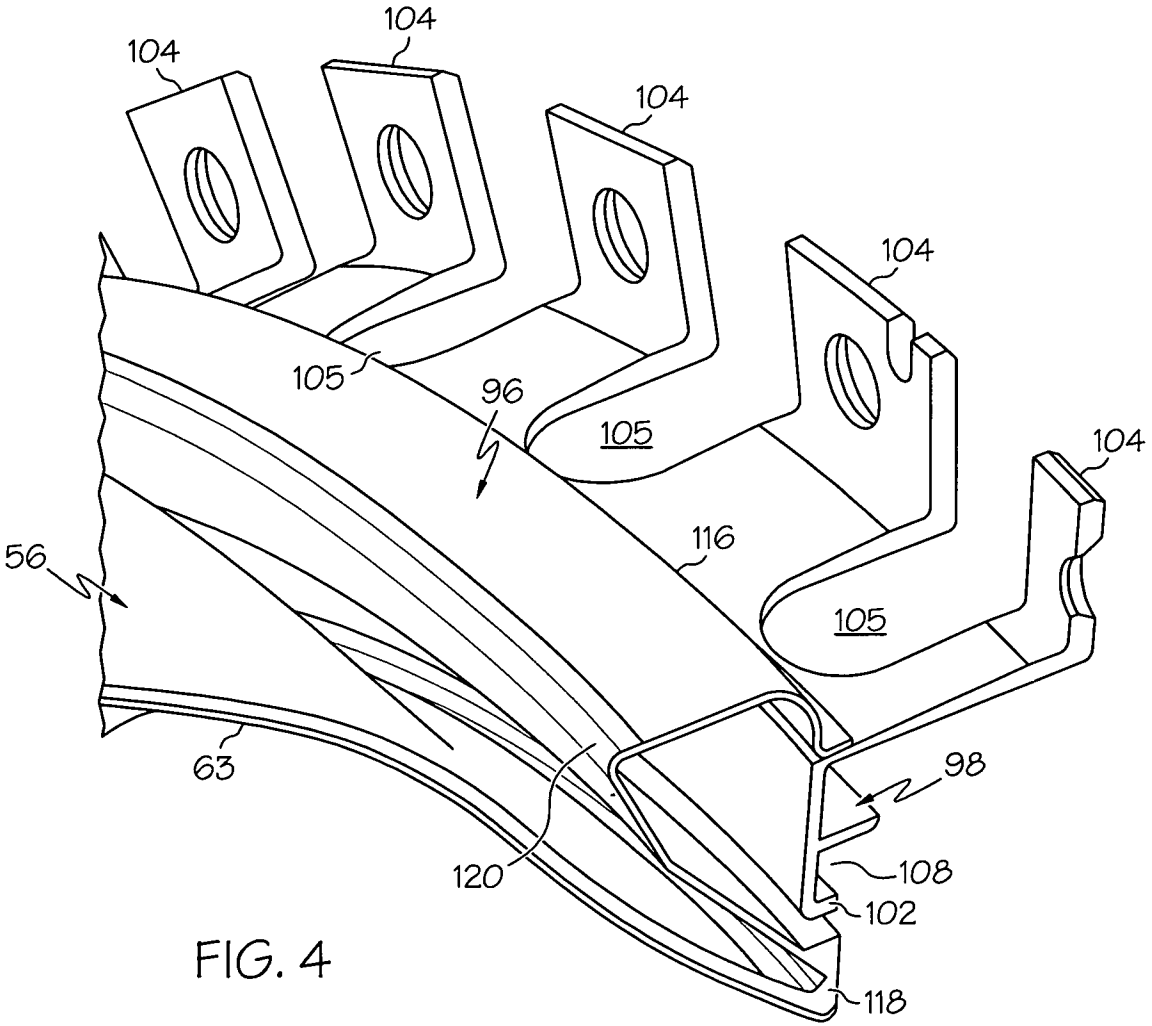
FIG. 4 is an isometric cross-sectional view of an upper portion of the compliant seal wall and the seal retainer included within the first compliant dual seal assembly shown in FIG. 3.

FIG. 3 is a cross-sectional view illustrating first compliant dual seal assembly 92 in greater detail. In the example shown in FIG. 3, compliant dual seal assembly 92 includes four main components: (i) a compliant seal wall 96, (ii) a seal retainer 98, (iii) a compression seal 100, and (iv) a bearing seal 124. Compliant seal wall 96 and seal retainer 98 are also shown in FIG. 4 in isometric cross-section. As can be most easily appreciated in FIG. 4, seal retainer 98 comprises a generally annular body 102 having a plurality of axially-elongated flanges 104 extending therefrom in a downstream direction. Axially-elongated flanges 104 are radially spaced to define a plurality of airflow channels 105 (FIG. 4) through seal retainer 98. Airflow channels 105 are radially interspersed between axially-elongated flanges 104 and permit airflow through seal retainer 98, and therefore around first compliant dual seal assembly 92, as indicated in FIG. 3 by arrows 82. Airflow channels 105 also increase the flexibility of seal retainer 98 along axially-elongated flanges 104 and, consequently, permit seal retainer 98 to better accommodate thermal displacement that may occur between the various components of seal assembly 92 and engine casing 48 as described more fully below. As shown most clearly in FIG. 3, each flange 104 may be mounted to engine casing 48 utilizing, for example, a bolt 106, a rivet, or other fastener (only one flange 104 and one bolt 106 is shown in FIG. 3 for clarity). When mounted to engine casing 48 in this manner, generally annular body 102 engages a first nozzle wall 111 (e.g., a radial flange) projecting from the main body of turbine nozzle 58 to physically capture turbine nozzle 58 and help maintain the radial position thereof.

With continued reference to FIGS. 3 and 4, an annulus 108 is provided within generally annular body 102 and receives compression seal 100 therein. When compliant dual seal assembly 92 is assembled, compression seal 100 is sealingly compressed between an inner surface of seal retainer 98 and first nozzle wall 111. When sealingly compressed in this manner, compression seal 100 eliminates or minimizes leakage between combustor 56 and turbine nozzle 58. In the illustrated example, compression seal 100 assumes the form of a metallic W-seal; however, in alternative embodiments, compression seal 100 may assume various other geometries (e.g., that of a C-seal, a V-seal, various other convolute seals, or an elastic gasket configuration) and may be formed from other suitable materials. In addition to carrying compression seal 100, seal retainer 98 also serves as a pilot to ensure precise radial alignment between the various components of combustor-turbine seal interface 60. First nozzle wall 111 may be directly affixed to or integrally formed with the main body of turbine nozzle 58. In embodiments wherein turbine nozzle 58 comprises a plurality of circumferentially-spaced turbine nozzles or turbine nozzle segments, each turbine nozzle may be individually mounted to first nozzle wall 111 utilizing bolts, rivets, or other mechanical fastening means.

With continued reference to FIG. 3, compliant seal wall 96 has a first end portion 116, a second end portion 118 substantially opposite first end portion 116, and an axially-overlapping intermediate portion 120 between first end portion 116 and second end portion 118. First end portion 116 of compliant seal wall 96 is fixedly coupled to seal retainer 98, and second end portion 118 of compliant seal wall 96 is fixedly coupled to a downstream end portion of combustor 56. In one embodiment, first end portion 116 is fabricated from sheet metal and/or machined from a forging and subsequently brazed or welded (e.g., e-beam structure welded, seam welded, etc.) to an outer circumferential portion of seal retainer 98. Second end portion 118 of compliant seal wall 96 may also be formed as a separate piece and subsequently affixed (e.g., brazed or welded) to intermediate portion 118 of compliant seal wall 96 and to a downstream end portion of combustor 56. In a preferred group of embodiments, axially-overlapping intermediate portion 120 has a generally conical geometry that accommodates the conical shape of combustor 56 while providing radial and axial compliancy as described more fully below.

Second end portion 118 of compliant seal wall 96 abuts turbine nozzle 58, and specifically a leading edge portion 122 of turbine nozzle 58, to form a bearing seal 124 between combustor 56 and turbine nozzle 58. As may be appreciated by referring to FIG. 4, compliant seal wall 96 is a substantially solid structure sealingly coupled between seal retainer 98 and liner wall 63 of combustor 56. Compliant seal wall 96 thus serves to generally prevent airflow from bypassing compression seal 100. As may be appreciated by referring to FIG. 3, compression seal 100 and bearing seal 124 are coupled in flow series and, in combination with compliant seal wall 96, significantly reduce leakage between combustor 56 and turbine nozzle 58. This, in turn, improves the overall efficiency of GTE 20 (FIG. 1). Additionally, the air saved from minimizing leakage between combustor 56 and turbine nozzle 58 can be utilized to cool the combustor or turbine components and/or utilized to tailor combustor aerodynamics. Although not shown in FIG. 3 for clarity, an aperture may be provided in a lower portion of complaint seal wall 96 (e.g., the bottom dead center of GTE 20) to allow residual fuel to drain from the cavity formed by compliant seal 96 and seal retainer 98.

Although compression seal 100 and bearing seal 124 significantly reduce the development of leakage paths between combustor 56 and turbine nozzle 58, a minimal amount of leakage may still occur between combustor 56 and turbine nozzle 58. If a leakage path should develop, leakage will generally flow from the exterior of combustor 56 and turbine nozzle 58 into the interior of combustor 56 and turbine nozzle 58 (indicated in FIG. 3 by leakage arrow 126). For this reason, it may be stated that compression seal 100 resides upstream of bearing seal 124 as taken along a combustor leakage path. In the illustrated exemplary embodiment, bearing seal 124 generally resides between compression seal 100 and outlet 68 of combustor 56.

As shown most clearly in FIG. 3, the outer portion of liner wall 63 and compliant seal wall 96 (in particular, the innermost segment of axially-overlapping intermediate portion 120) are radially spaced apart along their lengths. Collectively, compliant seal wall 96 and liner wall 63 define an effusion cooling path 128 along an outer surface of combustor 56 that extends to the downstream end of combustor 56. As indicated in FIG. 3 by arrows 130, the effusion cooling path 128 permits the cooler air flowing along cooling flow path 84 (also indicated by arrows 82 in FIG. 3) to flow substantially unimpeded over the downstream end of combustor 56. Thus, in contrast to certain known combustor-turbine sealing interfaces that block or restrict airflow to the downstream exterior of the combustor, compliant dual seal assembly 92 permits the entire body of combustor 56 to be effusively cooled.

To provide improved cooling of turbine nozzle 58, one or more cooling channels may be provided through second end portion of compliant seal wall 96 to direct a cooling jet against the leading portion of turbine nozzle 58 as shown in FIG. 3 at 132. Furthermore, as indicated in FIG. 3 at 113, the innermost circumferential edge of seal retainer 98 is radially offset from the neighboring portion of compliant seal wall 96. This radial offset or gap permits liner wall 63, which becomes relatively hot during combustion, to grow radially outward relative to compliant seal wall 96, which remains relatively cool during combustion. In a preferred embodiment, the radial clearance between seal retainer 98 and compliant seal wall 96 is such that complaint seal wall 96 seats on seal retainer 98 prior to the outlet of cooling channel 132 being obstructed by leading portion 122 of turbine nozzle 58. Stated differently, the innermost edge of generally annular body 104 of seal retainer 98 serves as a hard stop that physically prevents complaint seal wall 96 from growing radially outward to a positional extreme wherein cooling channel 132 is obstructed by the leading edge of turbine nozzle 58. In certain embodiments, second end portion 118 of seal wall 96 may not directly contact seal retainer 98 to provide a hard stop; instead, second end portion 118 may be formed to include one or more projections (e.g., a raised bump) that abut seal retainer 98 to provide a hard stop that prevents the obstruction of cooling channel 132.

In contrast to certain known combustor-turbine seal interfaces, combustor-turbine seal interface 60 is designed such that compression seal 100 is radially offset or spaced apart from the outlet of combustor 56. This radial offset results in an improved thermal isolation of compression seal 100 from the heated air exhausted from combustor 56 and the leading edge portion 122 of turbine nozzle 58, which becomes relatively hot during combustion. Excessive heating of compression seal 100 is thus avoided, and the sealing characteristics and structural integrity of compression seal 100 are maintained during operation of GTE 20 (FIG. 1).

As previously noted, compliant seal wall 96, and specifically axially-overlapping intermediate portion 120, provides a radial compliance between the hot downstream end portion of combustor 56 and the cooler seal retainer 98. This radial compliance permits compliant seal wall 96 to flex radially and thereby accommodate relative movement between combustor 56 and seal retainer 98. Furthermore, bearing seal 124 permits turbine nozzle 58 to slide radially relative second end portion 118 of compliant seal wall 96 while generally maintaining an airtight seal. Compliant seal wall 96 and bearing seal 124 thus cooperate to permit compliant dual seal assembly 92 to accommodate relative movement between the various components of combustor-turbine seal interface 60 that may occur as a result of thermal deflection. In this manner, thermomechanical fatigue within combustor-turbine seal interface 60 is reduced, and the operational lifespan of interface 60 is increased. Compliant seal wall 96 also provides an axial compliancy between engine casing 48 and the core components of GTE 20 (FIG. 1), which further helps to accommodate relative movement and to maintain a substantially constant axial load through compression seal 100 and bearing seal 124 to maintain the sealing characteristics thereof. Similarly, axially-elongated flanges 104 of seal retainer 98 provide a radial compliance between the main body of seal retainer 98, which undergoes considerable thermal expansion during combustion, and engine casing 48, which experiences relatively limited thermal expansion during combustion, and which maybe formed from a low thermal growth material, such as a titanium-based alloy. This again results in a reduction in thermomechanical stress, and an increase in operational lifespan.

Figure 5:
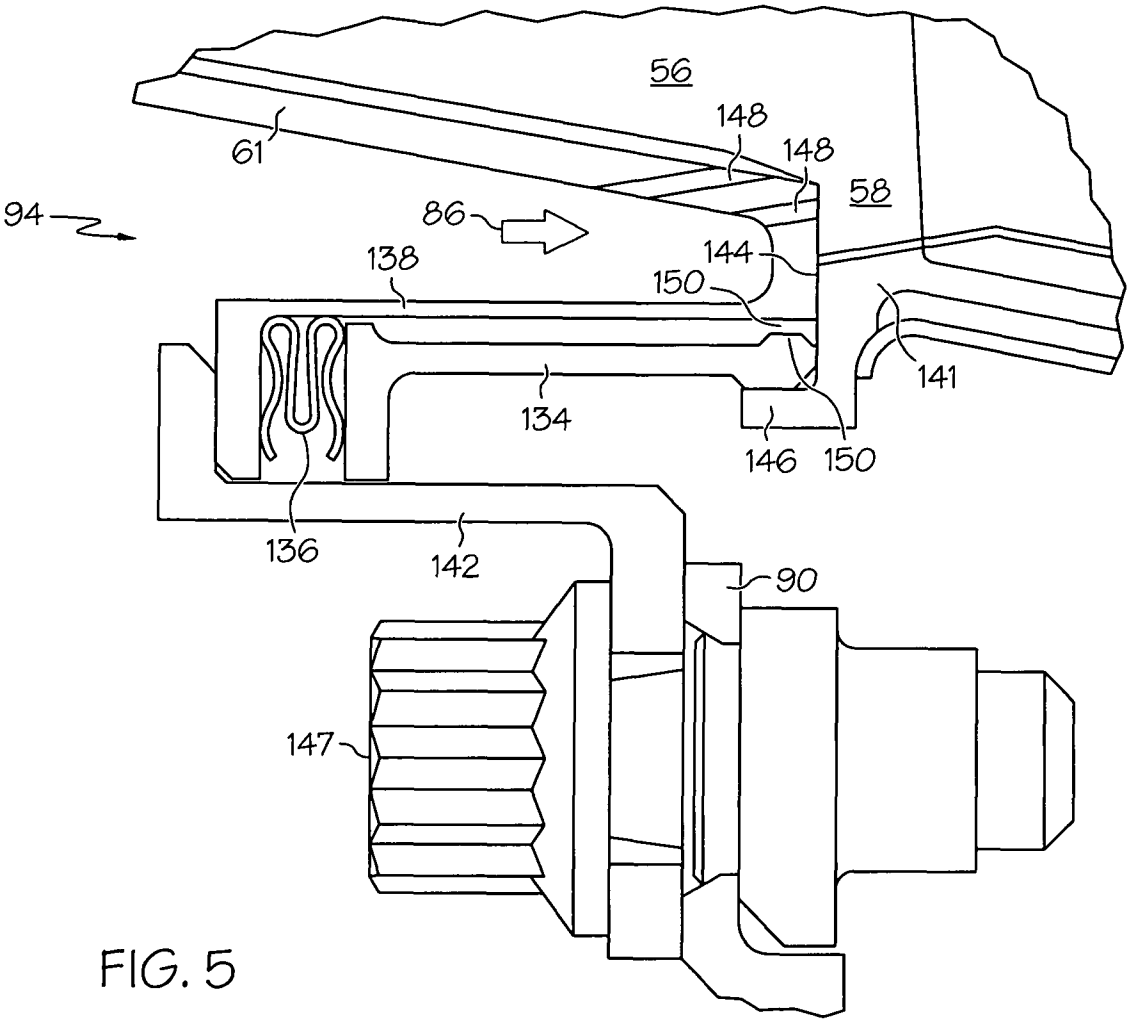
FIG. 5 is a cross-sectional view illustrating a second compliant dual seal assembly employed by the combustor-turbine seal interface shown in FIG. 2 in accordance with an exemplary embodiment.

FIG. 5 is a cross-sectional view illustrating second compliant dual seal assembly 94 in greater detail. Second compliant dual seal assembly 94 includes an outer beam structure 138 and an inner beam structure 134. The downstream end of outer beam structure 138 is fixedly coupled (e.g., welded or brazed) to liner wall 61 of combustor 56. The downstream end portion of inner beam structure 134 abuts and is captured by a radial lip 146 provided around turbine nozzle 58. Outer beam structure 138 axially overlaps with inner beam structure 134 to form a radial spring member that provides radial compliance between combustor 56 and internal mounting structure 90. Outer beam structure 138 is retained by a flange 142, which may be mounted to internal mounting structure 90 utilizing, for example, a plurality of bolts 147 (only one of which is shown in FIG. 5), rivets, or other such fasteners. Collectively, beam structures 138 and 142 provided a radial compliance to accommodate relative movement that may occur between combustor 56 and structure 90 during combustion. In so doing, beam structures 138 and 142 minimizes mechanical stressors within second compliant dual seal assembly 94 and thereby increase the operational lifespan of GTE 20 (FIG. 1).

As was the case with first compliant dual seal assembly 92, second compliant dual seal assembly 94 includes a compression seal 136 and a bearing seal 144. Compression seal 136 (e.g., a metallic W-seal) is sealingly compressed between the upstream end portion of outer beam structure 138 and the upstream end portion of inner beam structure 134 (e.g., a radial flange), which is attached to turbine nozzle 58. Bearing seal 144 is generally defined by the downstream end of outer beam structure 138 and the leading edge portion of turbine nozzle 58. Bearing seal 144 and compression seal 136 are coupled in series, and bearing seal 144 generally resides between compression seal 136 and the downstream outlet of combustor 56. Bearing seal 144 and compression seal 136 cooperate to significantly reduce or eliminate leakage between combustor 56 and turbine nozzle 58 and thereby improve the efficiency of GTE 20 (FIG. 1). Notably, beam structures 138 and 134 position compression seal 136 at a location that is axially offset from the leading edge portion of turbine nozzle 58, which becomes relatively hot during combustion. By offsetting compression seal 136 from turbine nozzle 58 in this manner, compression seal 136 may be maintained in a cooler state and the sealing characteristics of compression seal 136 may be better preserved during operation of GTE 20 (FIG. 1).

One or more cooling channels 148 may be provided through the downstream end portion of outer beam structure 138 to form cooling jets that cool turbine nozzle 58 during operation of GTE 20. More specifically, cooling channels 148 direct the relatively cool air flowing between liner wall 61 and outer beam structure 138 (represented in FIG. 5 by arrow 86) against the leading edge portion of turbine nozzle 58 to convectively cool turbine nozzle 58. As further shown in FIG. 5, a radial gap 150 may be provided between the downstream end of outer beam structure 138 and the downstream end of inner beam structure 134. Radial gap 150 generally accommodates the transient inward growth of liner wall 61 and outer beam structure 138 relative to inner beam structure 134. Inner beam structure 134 may cool more slowly during a deceleration transient than liner wall 61 and outer beam structure 138, which would result in an interference unless gap 150 is provided. At the same time, the radial width of radial gap 150 is preferably such that outer beam structure 138 contacts inner beam structure 134 as the leading edge portion of turbine nozzle 58 and flange 146 grow radially outward, to provide a hard stop before cooling channels 148 are obstructed by the leading edge portion of turbine nozzle 58.

The foregoing has thus provided an exemplary embodiment of a combustor-turbine nozzle-case assembly that significantly reduces or eliminates leakage between the combustor and the turbine nozzle. In foregoing example, the combustor-turbine nozzle-case assembly employed at least one compliant dual seal assembly having a radial compliance that accommodates relative movement between the combustor, the turbine nozzle, and the engine casing to reduce thermomechanical fatigue and thus increase operational lifespan of combustor-turbine seal interface. It should be appreciated that, in the above-described exemplary embodiment, the combustor-turbine seal interface promoted efficient cooling of the combustor and the leading edge portion of the turbine nozzle. It should also be appreciated that the above-described combustor-turbine seal interface provided aerodynamically efficient flow paths for the heated air exhausted from the combustor and for the cooler air bypassing the combustor.

While at least one exemplary embodiment has been presented in the foregoing Detailed Description, it should be appreciated that a vast number of variations exist. It should also be appreciated that the exemplary embodiment or exemplary embodiments are only examples, and are not intended to limit the scope, applicability, or configuration of the invention in any way. Rather, the foregoing Detailed Description will provide those skilled in the art with a convenient road map for implementing an exemplary embodiment of the invention. It being understood that various changes may be made in the function and arrangement of elements described in an exemplary embodiment without departing from the scope of the invention as set-forth in the appended Claims.

What is claimed is:

1. A combustor-turbine seal interface for deployment within a gas turbine engine, the combustor-turbine assembly comprising:

a combustor;

a turbine nozzle downstream of the combustor; and a first compliant dual seal assembly, comprising:

a compliant seal wall sealingly coupled between the combustor and the turbine nozzle;

a first compression seal sealingly disposed between the compliant seal wall and the turbine nozzle; and a first bearing seal generally defined by the interface between the turbine nozzle and a first end portion of the compliant seal wall abutting the turbine nozzle, the first end portion of the compliant seal wall fixedly coupled to the downstream end of the combustor, the first bearing seal fluidly coupled in series with the first compression seal and allowing sliding movement between the combustor and the turbine nozzle in a radial direction.

2. A combustor-turbine seal interface according to claim 1 wherein the first compression seal is disposed upstream of the first bearing seal as taken along a combustor leakage path.

3. A combustor-turbine seal interface according to claim 1 wherein the combustor includes an outlet, and wherein the first bearing seal generally resides between the outlet and the first compression seal.

4. A combustor-turbine seal interface according to claim 1 wherein the first bearing seal resides closer to the longitudinal axis of the gas turbine engine than does the first compression seal.

5. A combustor-turbine seal interface according to claim 1 wherein the first bearing seal resides radially displaced from the first compression seal.

6. A combustor-turbine seal interface according to claim 1 further comprising a seal retainer coupled between the compliant seal wall and the turbine nozzle.

7. A combustor-turbine seal interface according to claim 6 wherein the seal retainer comprises a substantially annular body, the compression seal sealingly compressed between the substantially annular body and the turbine nozzle.

8. A combustor-turbine seal interface according to claim 7 wherein the gas turbine engine includes an engine casing, and wherein seal retainer further comprises a plurality of axially-elongated flanges fixedly coupled to the engine casing.

9. A combustor-turbine seal interface according to claim 8 wherein the seal retainer further comprises a plurality of flow passages formed therethrough, the plurality of flow passages interspersed with the plurality of axially-elongated flanges.

10. A combustor-turbine seal interface according to claim 6 wherein the compliant seal wall comprises:

a second end portion fixedly coupled to the seal retainer.

11. A combustor-turbine seal interface according to claim 10 wherein the compliant seal wall further comprises an axially-overlapping portion intermediate the first end portion and the second end portion, the axially overlapping portion providing a radial compliance between the combustor and the seal retainer.

12. A combustor-turbine seal interface according to claim 11 wherein the combustor includes a liner wall, and wherein the axially-overlapping portion is radially offset from the liner wall to define an effusion cooling path extending toward the downstream end of the combustor.

13. A combustor-turbine seal interface according to claim 6 further comprising a nozzle wall coupled to the turbine nozzle, the first compression seal sealingly deformed between the seal retainer and the nozzle wall.

14. A combustor-turbine seal interface according to claim 6 further comprising a second compliant dual seal assembly, the second compliant dual seal assembly coupled between an inner portion of the combustor and the turbine nozzle, and the first compliant dual seal assembly coupled between an outer portion of the combustor and the turbine nozzle.

15. A combustor-turbine seal interface according to claim 14 wherein the second compliant dual seal assembly comprises:

a first beam structure having a downstream end portion fixedly coupled to a downstream end portion of the combustor;

a second beam structure having a downstream end portion abutting the turbine nozzle, the second beam structure axially overlapping with the first beam structure to provide a radial compliance between the combustor and the turbine nozzle; and a second compression seal sealingly compressed between an upstream end portion of the first beam structure and an upstream end portion of the second beam structure.

16. A combustor-turbine seal interface according to claim 15 wherein the downstream end portion of the first beam structure abuts the turbine nozzle to form a second bearing seal in series with the second compression seal.

17. A combustor-turbine seal interface for deployment within a gas turbine engine, the combustor-turbine assembly comprising:

a combustor;

a turbine nozzle downstream of the combustor; and a compliant dual seal assembly, comprising:

a compliant seal wall having a first end portion and a second end portion, the first end portion fixedly coupled to a downstream end portion of the combustor and abutting the turbine nozzle to define a bearing seal allowing radial sliding movement between the turbine nozzle and the combustor, the compliant seal wall further having a generally conical intermediate portion between the first end portion and the second end portion and extending around the downstream end portion of the combustor;

a seal retainer coupled between the turbine nozzle and the second end portion of the compliant seal wall; and a compression seal sealingly coupled between the seal retainer and the turbine nozzle, the compression seal disposed upstream of the bearing seal as taken along a combustor leakage path.

18. A combustor-turbine seal interface according to claim 17 wherein the compliant seal wall is sealingly coupled between a downstream portion of the turbine nozzle and the seal retainer so as to substantially prevent airflow from bypassing the compression seal and the compliant seal wall.

19. A combustor-turbine seal interface for deployment within a gas turbine engine including an engine casing, the combustor-turbine assembly comprising:

a combustor;

a turbine nozzle downstream of the combustor; and a compliant dual seal assembly, comprising:

a seal retainer, comprising:

a generally annular body disposed adjacent the turbine nozzle;

a plurality of axially-elongated flanges extending from the generally annular body in an upstream direction, the plurality of axially-elongated flanges configured to be mounted to the engine casing and to provide a radial compliancy between the generally annular body and the engine casing; and a plurality of airflow channels formed through the seal retainer proximate the plurality of axially-elongated flanges;

a compression seal sealingly compressed between the annular body and the turbine nozzle;

a compliant seal wall sealingly coupled between a downstream end portion of the combustor and the seal retainer, the compliant seal wall having an end portion fixedly coupled to the downstream end portion of the combustor and further having a generally conical intermediate portion extending around the downstream end portion of the combustor; and a bearing seal generally defined by the interface between the compliant seal wall and an upstream end portion of the turbine nozzle, the bearing seal coupled in series with the compression seal and allowing sliding movement between the combustor and the turbine nozzle in a radial direction.

* * * * *